US006384778B1

(12) United States Patent
Campbell

(10) Patent No.: US 6,384,778 B1
(45) Date of Patent: May 7, 2002

(54) AIRBORNE SATELLITE COMMUNICATION SYSTEM HAVING A SATELLITE SELECTION ALGORITHM THEREIN WHICH IS DEPENDENT UPON AN ANTENNA MOUNTING CHARACTERISTIC AND AN ANGULAR DISTANCE BETWEEN AN ANTENNA NORMAL LINE AND A LINE TO A SATELLITE

(75) Inventor: Thomas B. Campbell, Cedar Rapids, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 0 days.

(21) Appl. No.: 09/364,385

(22) Filed: Jul. 30, 1999

(51) Int. Cl.[7] ..... H01Q 3/00
(52) U.S. Cl. ..... 342/359

(58) Field of Search ..... 342/359; 343/705

(56) References Cited

U.S. PATENT DOCUMENTS 5,463,656 A * 10/1995 Polivka et al. ..... 375/130
6,023,242 A * 2/2000 Dixon ..... 342/359
6,061,019 A * 5/2000 Miyoshi ..... 342/359

* cited by examiner

*Primary Examiner*—Gregory C Issing
(74) *Attorney, Agent, or Firm*—Nathan O. Jensen; Kyle Eppele

(57) ABSTRACT

A satellite communication system for aircraft having other than top-mounted satellite communication antennas, wherein the system includes an ability to optimize the operation of the system depending on the existence of other than top-mounted antennas and/or the angular distance between a normal line of such antennas and a line drawn from the antenna to a satellite.

1 Claim, 4 Drawing Sheets

AIRBORNE SATELLITE COMMUNICATION SYSTEM HAVING A SATELLITE SELECTION ALGORITHM THEREIN WHICH IS DEPENDENT UPON AN ANTENNA MOUNTING CHARACTERISTIC AND AN ANGULAR DISTANCE BETWEEN AN ANTENNA NORMAL LINE AND A LINE TO A SATELLITE

CROSS REFERENCE TO RELATED APPLICATIONS

The present invention relates to copending application entitled "DUAL MODE SATELLITE TERMINAL FOR EMERGENCY OPERATION" filed on even date herewith by the same inventor and assigned to the same assignee.

BACKGROUND OF THE INVENTION

The present invention relates to satellite communication systems and more particularly relates to airborne satellite communications systems and even more particularly relates to airborne satellite communication systems with a satellite antenna mounted on an aircraft at a position other than the top of the aircraft.

In the past, airborne satellite communication systems have been used extensively for aircraft to communicate, via satellite, to terrestrial positions. In many areas of the earth, a typical satellite communications system may have several satellites between which to choose for its communication path. Often these systems make their selection between these several satellites primarily upon the elevation angle of the satellite above the horizon.

While use of elevation angle for satellite selection has some beneficial aspects, especially for top-mounted antennas, it does have serious drawbacks, especially for antennas mounted in positions other than the top of the aircraft.

Consequently, there exists a need for improved satellite communication systems which utilize other than top mounted antennas.

SUMMARY OF THE INVENTION

It is an object of the present invention to increase the capacity of airborne satellite communication systems.

It is a feature of the present invention to use side mounted antennas and an algorithm selecting satellites based upon their orthogonality with respect to the plane of the antenna on the aircraft.

It is an advantage of the present invention to increase the effectiveness of satellite communication antennas by improving the cross-sectional area of the antenna capable of capturing signals incident thereon.

It is another object of the present invention to reduce the time required for satellite selection.

It is another feature of the present invention to eliminate the need for mapping each antenna upon initialization of the satellite communication system.

It is another advantage of the present invention to allow airlines to maintain their telephone service in operation for longer time periods, thereby increasing revenues and profits.

It is yet another object of the present invention to provide for a more versatile satellite communication transmitter.

It is yet another feature of the present invention to include a satellite selection feature which will bias the satellite selection based upon particular characteristics of the antenna system in use.

It is yet another advantage of the present invention to reduce reconfirmation expense associated with reconfirming the satellite communication transmitter for differing aircraft installations and antenna characteristics.

The present invention is a method and apparatus for selecting among several available satellites by a satellite communications system, which system includes at least some antennas other than top-mounted antennas which is designed to satisfy the aforementioned needs, provide the previously stated objects, include the above listed features and achieve the already articulated advantages.

Accordingly, the present invention is a method and apparatus including a satellite selection algorithm which utilizes information relating to the types and locations of antennas on the aircraft and to the angle between an antenna normal line and a line to a satellite.

BRIEF DESCRIPTION OF THE DRAWINGS

The invention may be more fully understood by reading the following description of the preferred embodiments of the invention in conjunction with the appended drawings wherein.

DETAILED DESCRIPTION

Figure 1:
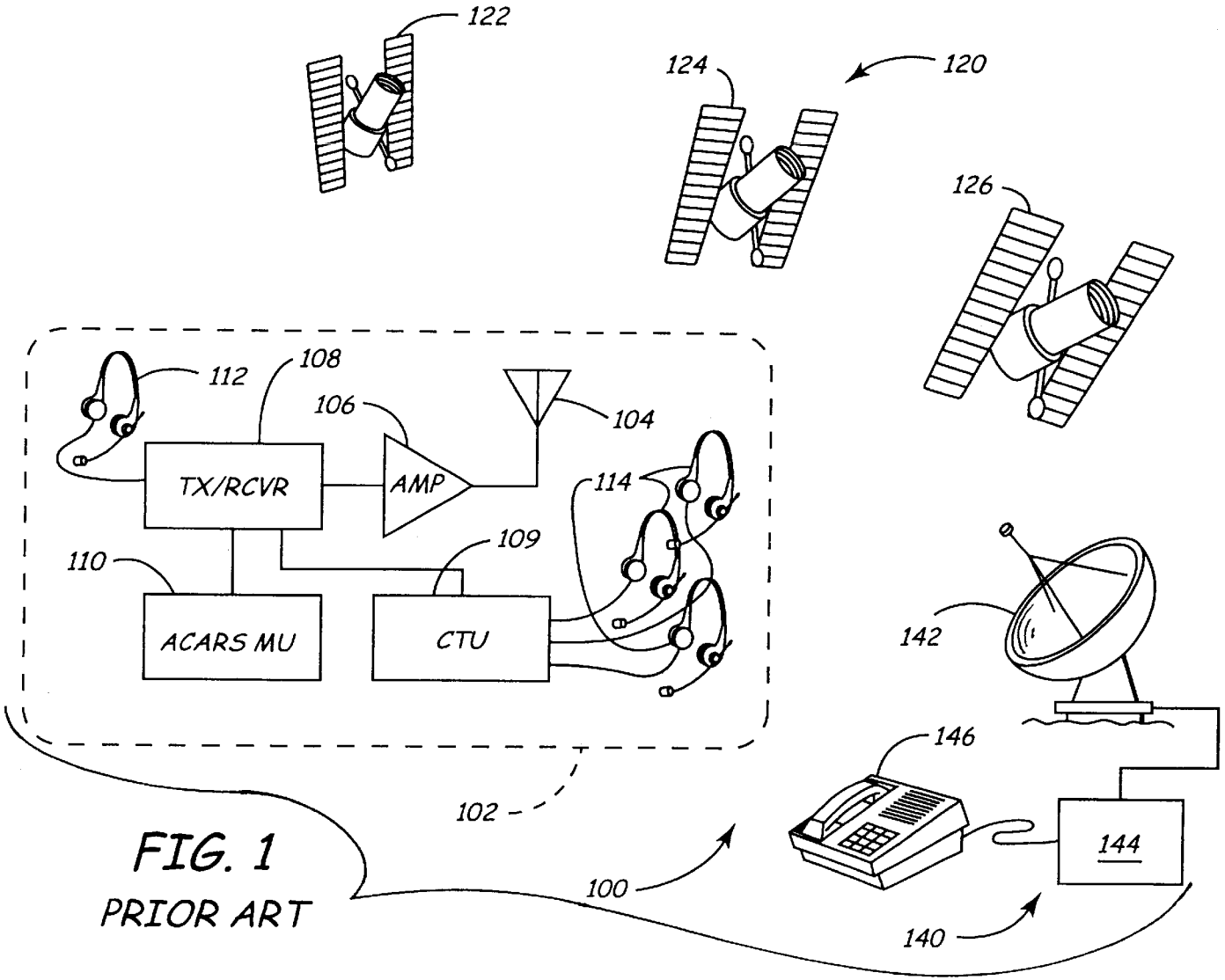
FIG. 1 PRIOR ART
FIG. 1 is a schematic diagram of a prior art satellite communication system.

Now referring to the drawings, wherein like numerals refer to like matter throughout, and more particularly to FIG. 1, there is shown a schematic representation of a satellite communication system, generally designated 100 of the prior art, including an airborne earth station segment 102, a satellite segment 120, and a ground earth station segment 140.

Airborne earth station segment 102 is shown having an antenna 104, which is typically disposed on the exterior surface of the aircraft and is typically designed for communicating with the satellite segment 120, using RF communication in the L band; however, other frequencies could be readily substituted. Antenna 104 is coupled through amplifier 106 to transmitter/receiver 108. An ACARS Management Unit (ACARS MU) 110 is shown coupled with transmitter/receiver 108 having a crew headset 112 coupled thereto. A cabin terminal unit (CTU) 109 is shown coupling the passenger headsets 114 with the transmitter/receiver 108. Airborne earth station segments 102 are well known in the art, and numerous modifications and variations of that which is depicted herein are also readily known.

The satellite segment 120 of the satellite communication system 100 is shown having three satellites 122, 124 and 126. Satellite systems may have varying numbers of satellites, and three are shown here only for purposes of simplicity. First satellite 122 is generally depicted in a position above the airborne earth station segment 102. As situated, it is intended to depict a satellite having the highest elevation angle above the horizon. Satellite 124 has an elevation angle between satellite 122 and satellite 126. Satellite 126 is intended to depict a satellite whose elevation above the horizon is a smaller angle than either satellite 122 or 124.

Ground earth station segment 140 is shown as a ground based satellite antenna 142 positioned at a terrestrial location and typically communicating with satellite segment 120 over the C band; however, other frequencies could be readily substituted. Signals received by ground based satellite antenna 142 are then provided over some terrestrial based communication network 144, which could be any type of communication system known in the art. An end user station 146 can be any type of end user operating any type of communication equipment, such as a telephone, computer, etc.

In operation, the prior art satellite communication system 100 may operate as follows: passengers or members of the flight crew on board an aircraft desirous of communicating with an end user station 146, initiate a voice or data call from crew and passenger headsets 112 and 114 respectively. These signals are processed by transmitter/receiver 108 and amplifier 106 and emitted through antenna 104 to a satellite in the satellite segment 120. One of the satellites, acting as a relay station, typically receives signals transmitted from the airborne earth station segment 102 on one frequency, and then relays it to a ground based satellite antenna 142 on another frequency. Signals from the crew and passenger headsets 112 and 114 respectively continue over communication network 144 and are ultimately delivered to end user station 146.

Figure 2:
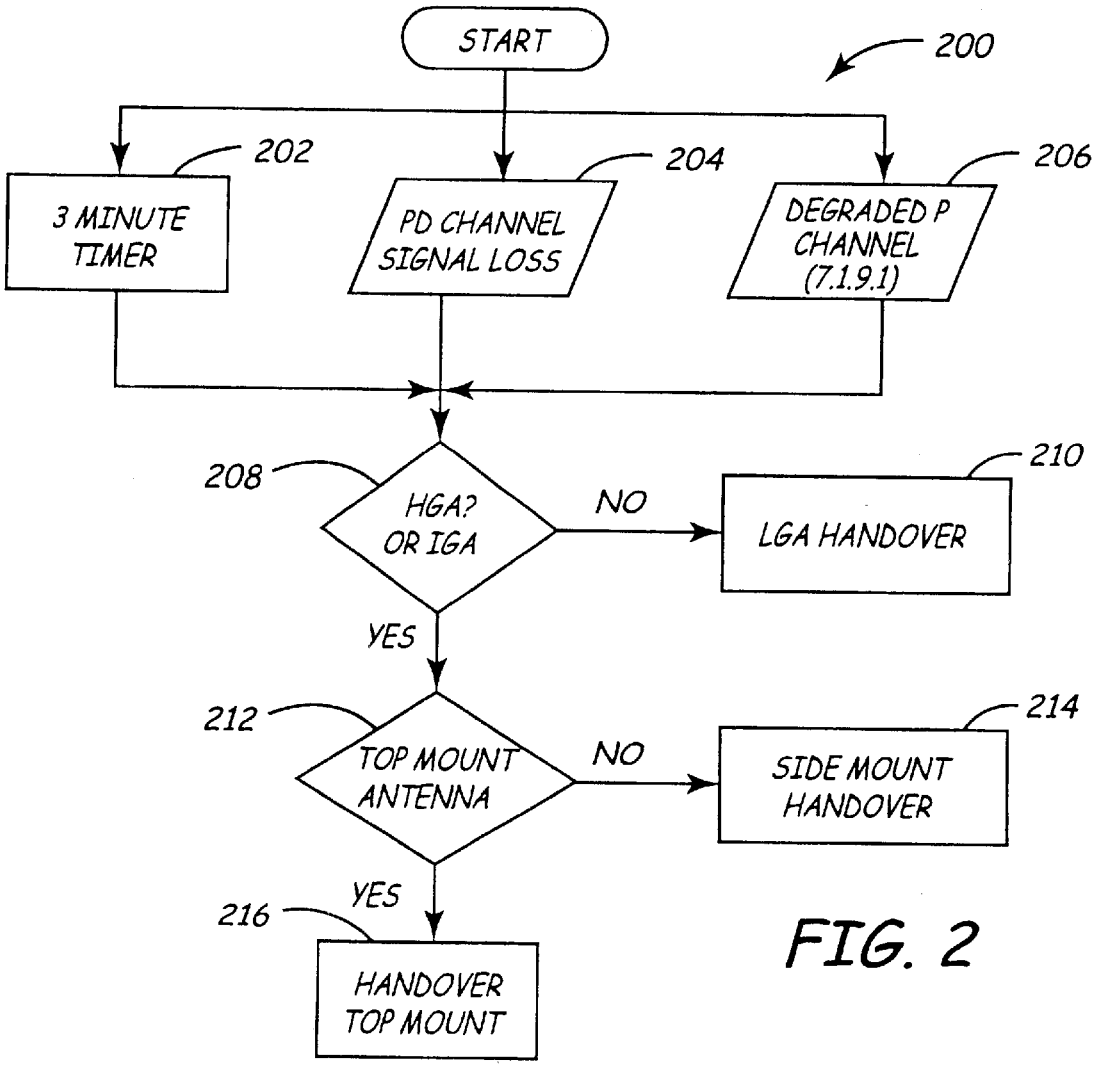
FIG. 2 is a flow diagram of a method of satellite selection of the present invention.

Now referring to FIG. 2, there is shown a flow diagram, generally designated 200, of the present invention which includes three possible events which could initiate a new inquiry into satellite selection process including the expiration of a timer 202 (which may be a three-minute timer), the signal loss of the P channel as shown in block 204, as well as a degradation in the P channel as shown in the block 206. If either of the events 202, 204 or 206 occurs, then the satellite communication system will perform the remaining functions, the first of which would be a determination in block 208 of whether the satellite communication system utilizes a high gain antenna or an intermediate gain antenna. If the answer to this determination is "no", then a low gain antenna handover algorithm 210 would be followed. These low gain antenna handover algorithms are currently in use and are well known in the industry. If the determination from block 208 is that a high gain or intermediate gain antenna is in use, then decision 212 must be addressed, and that is whether there is a top mount antenna. If the answer to the top mount antenna question 212 is "yes", then block 216 should be followed, which depicts the top mount handover algorithm. Top mount handover algorithm 216 is currently in use in the industry and is well known. However, if the top mount antenna determination 212 results in a decision of "no", then, as shown in block 214, a side mount handover algorithm is implemented.

Figure 3:
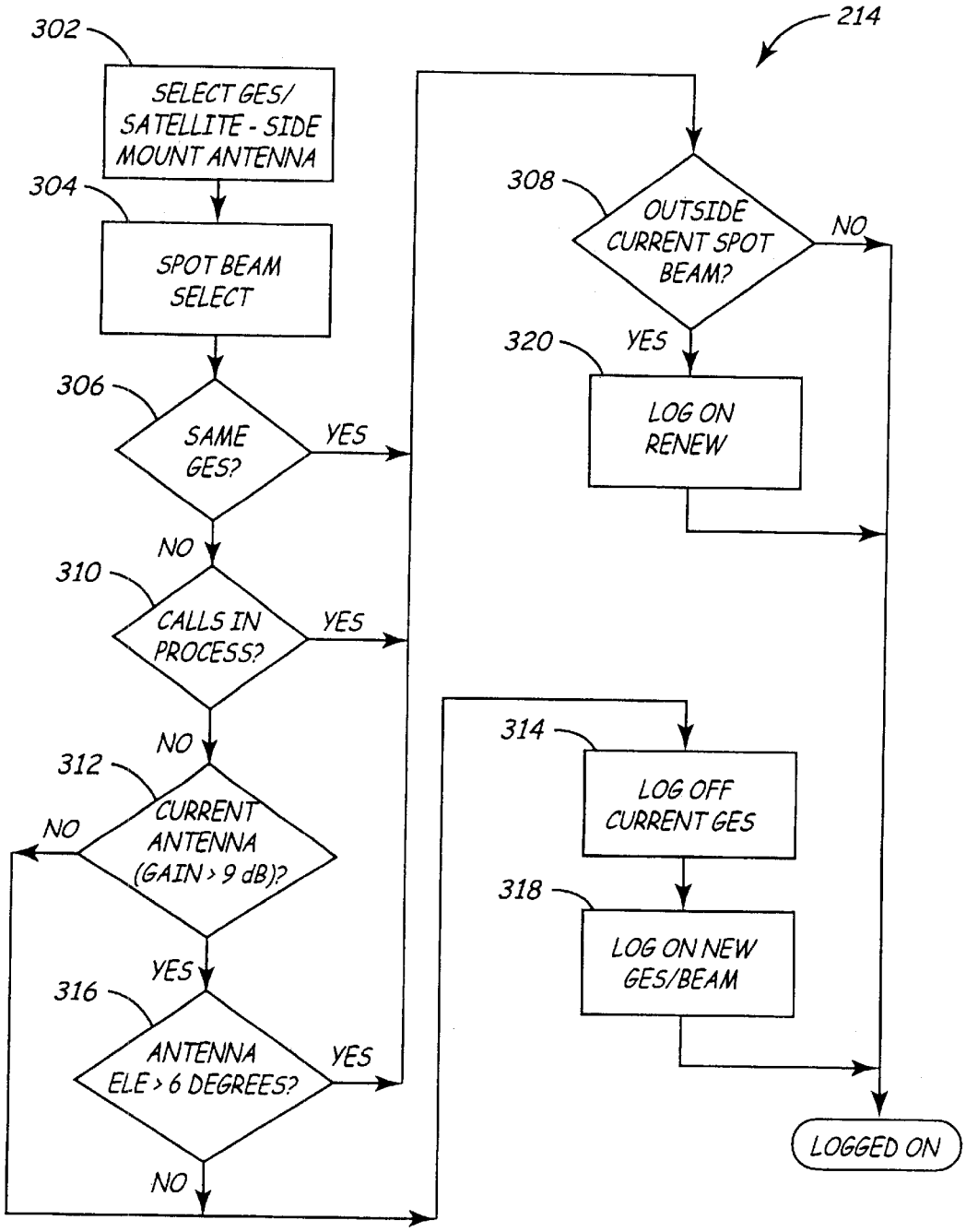
FIG. 3 is a more detailed flow diagram of the "side-mount handover" section of FIG. 2.
Figure 4:
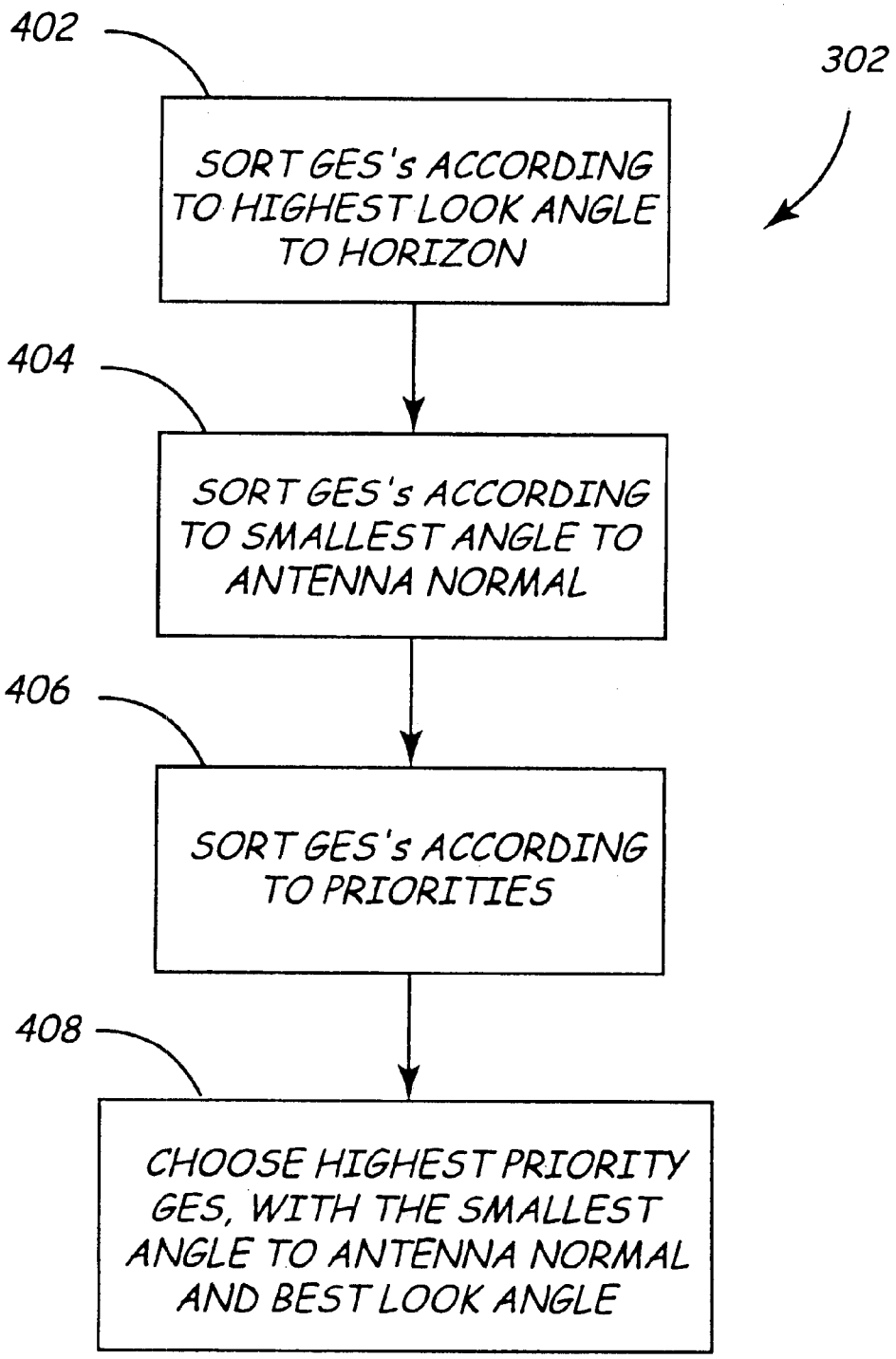
FIG. 4 is a more detailed flow diagram of the "select GES/Satellite-side-mount antenna" block of FIG. 3.

Now referring to FIG. 3, there is shown a detailed flow diagram of the side mount handover 214 of FIG. 2 which begins with a block 302 entitled "select GES/satellite-side mount antenna", which is the subject of FIG. 4 and its accompanying discussion. Once the algorithm 302 is performed, a spot beam selection is made pursuant to block 304. An inquiry 306 as to whether or not you are communicating with the same ground earth station GES is made. If the answer is "yes", then proceed to decision point 308. However, if the answer is "no", and you are not in the same GES, you should, in accordance with decision mode 310, determine whether or not there are any calls in process. If there are calls in process, then proceed to decision point 308. If there are no calls in process, then decision point 312 is next considered. Decision Point 312 involves determining whether the current antenna gain is greater than 9 dB, a user definable value. If the answer is "no", then the process goes to log off current GES block 314. However, if the decision from decision point 312 is "yes", and the current antenna gain is greater than 9 dB, a user definable value, then decision point 316 further inquires whether the antenna elevation angle is greater than 6 degrees, a user definable value. If the answer is "yes" to decision 316, then the process proceeds to decision block 308. However, if the answer is "no", and the elevation angle of the satellite is less than or equal to 6 degrees, a user definable value, then it is believed that the satellite is too near the horizon to be considered for use in the future and the process proceeds to the log off current GES block 314. Once the log off occurs, the next step is Step 318, which would involve logging on to a new GES beam. However, if the process were directed to decision point 308, then a determination there must be made as to whether the current aircraft location is outside the current spot beam in use. If the answer is "no", then the process will remain logged on to the current GES and spot beam. However, if the answer is "yes", then the log on renew function 320 is performed. Logon renew function involves resetting certain parameters relating to events 202, 204, and 206 of FIG. 2.

Now referring to FIG. 4, there is shown a more detailed flow diagram of the block 302 of FIG. 3. The first process of block 302 involves the process 402 sorting the GES's according to highest look angle to horizon. Next, a sorting of GES's according to smallest angle to the normal to the antenna is performed in accordance with block 404. Thereafter, in accordance with block 406, a sorting is done of GES's according to user specified priorities. Finally, in accordance with block 408, a determination of a GES is made based upon satellites with the highest priority, with the smallest angle to antenna normal and the best look angle. The order of GES selection is such that the highest priority GES will always be chosen. However, if two or more GES's have the same priority, then the GES chosen will have the smallest angle to antenna normal. However, in the event that GES's with the same priority have approximately the same angle to the antenna normal, then the GES with the highest elevation angle is preferred.

It is thought that the method and apparatus of the present invention will be understood from the foregoing description and that it will be apparent that various changes may be made in the form, construction, steps and arrangements of the parts and steps thereof, without departing from the spirit and scope of the invention or sacrificing all of their material advantages. The form herein described is merely a preferred or exemplary embodiment thereof.

I claim:

1. A method of communicating via satellite comprising the steps of:

providing an airborne transmitter;

providing an antenna coupled to said airborne transmitter wherein said antenna is disposed at a position on an aircraft other than a position on top of the aircraft pointing toward a zenith of the aircraft;

determining a plurality of antenna orientation angles each from a normal line of said antenna to one of a plurality of satellites;

making a satellite selection based upon said plurality of antenna orientation angles; and wherein said satellite selection favors satellites having increasing elevation angles over time.

* * * * *